US008304676B2

(12) United States Patent
Uchii et al.

(10) Patent No.: US 8,304,676 B2
(45) Date of Patent: Nov. 6, 2012

(54) GAS INSULATED SWITCHGEAR

(75) Inventors: Toshiyuki Uchii, Kanagawa (JP); Yoshihiko Hirano, Tokyo (JP); Yoshikazu Hoshina, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 45 days.

(21) Appl. No.: 12/955,181

(22) Filed: Nov. 29, 2010

(65) Prior Publication Data

US 2011/0127237 A1 Jun. 2, 2011

Related U.S. Application Data

(63) Continuation-in-part of application No. PCT/JP2009/002280, filed on May 25, 2009.

(30) Foreign Application Priority Data

May 29, 2008 (JP) ..... 2008-140413

(51) Int. Cl.
*H01H 33/88* (2006.01)

(52) U.S. Cl. ..... 218/62; 218/53; 218/85

(58) Field of Classification Search ..... 218/53, 218/62, 85

See application file for complete search history.

(56) References Cited

U.S. PATENT DOCUMENTS

| | | | | |
|---|---|---|---|---|
| 5,902,980 | A * | 5/1999 | Reincke et al. | 218/155 |
| 6,437,273 | B2 * | 8/2002 | Stechbarth et al. | 218/3 |
| 6,437,274 | B2 * | 8/2002 | Claessens et al. | 218/3 |
| 7,816,618 | B2 * | 10/2010 | Uchii | 218/43 |
| 2007/0221626 | A1 | 9/2007 | Uchii | |

FOREIGN PATENT DOCUMENTS

| | | |
|---|---|---|
| JP | 58-158802 | 9/1983 |
| JP | 63-144706 | 6/1988 |
| JP | 7-97466 | 10/1995 |
| JP | 7-109744 | 11/1995 |
| JP | 2000-164040 | 6/2000 |
| JP | 2001-189118 | 7/2001 |
| JP | 2003-348721 | 12/2003 |
| JP | 2005-328600 | 11/2005 |
| JP | 2007-258137 | 10/2007 |
| JP | 2008-084768 | 4/2008 |

OTHER PUBLICATIONS

International Preliminary Report on Patentability and Written Opinion issued Jan. 11, 2011, in PCT/JP2009/002280 filed May 25, 2009.
Office Action issued Jul. 24, 2012 in Japanese patent application No. 2008-140413.
International Search Report issued Jul. 21, 2009 in PCT/JP2009/002280 filed May 25, 2009.

* cited by examiner

*Primary Examiner* — Truc Nguyen
(74) *Attorney, Agent, or Firm* — Oblon, Spivak, McClelland, Maier & Neustadt, L.L.P.

(57) ABSTRACT

Disclosed is a gas insulated switchgear constituted such that electrical contacts are placed inside a sealed vessel filled with an arc extinguishing gas, and when electrical current passes, the electrical contacts are held in contact and pass electricity, and when the current is interrupted, the electrical contacts are separated and an arc discharge is produced in the arc extinguishing gas, and the current is interrupted by extinguishing this arc. The arc extinguishing gas is a mixed gas, the main constituents of which are $N_2$ gas and $CH_4$ gas, and the $CH_4$ content is at least 30%. Alternatively, the arc extinguishing gas is a mixed gas, the main constituents of which are $CO_2$ gas and $CH_4$ gas, and the $CH_4$ content is at least 5%.

22 Claims, 7 Drawing Sheets

| KIND OF GAS | RELATIVE WITHSTAND VOLTAGE PERFORMANCE (%) |
|---|---|
| $CO_2$ | 100 |
| $O_2$ | 111~122 |
| $CH_4$ | 112~120 |
| $H_2$ | 6~9 |

GAS INSULATED SWITCHGEAR

CROSS REFERENCES TO RELATED APPLICATIONS

This application is a continuation-in-part (CIP) application based upon the International Application PCT/JP2009/002280, the International Filing Date of which is May 25, 2009, the entire content of which is incorporated herein by reference, and is based upon and claims the benefits of priority from the prior Japanese Patent Applications No. 2008-140413, filed in the Japanese Patent Office on May 25, 2008, the entire content of which is incorporated herein by reference.

FIELD

The present invention relates to a gas insulated switchgear and, more particularly, to a gas insulated switchgear reducing use of greenhouse effect gases.

BACKGROUND

As a switchgear having a current interrupting function, various types such as a load switchgear, a disconnector, and a circuit breaker, exist depending on use purpose and required function. Most of the above switchgears are constituted such that electrical contacts that can be mechanically opened and closed are placed in a gas atmosphere, and when electrical current passes, the electrical contacts are held in contact for conduction, and when the current is interrupted, the electrical contacts are separated and an arc discharge is produced in the gas atmosphere, and the current is interrupted by extinguishing this arc.

In recent years, for the purpose of obtaining higher current interruption performance, there is proposed a method that obtains higher spraying pressure not only by utilizing mechanical pressure of a piston but also by actively introducing heat energy of the arc into a puffer chamber. For example, there is proposed a method that introduces a movable-side hot gas flow into the puffer chamber through a hole formed in a hollow rod at the initial time of the interruption operation (refer to Japanese Patent Publication No. 07-109744, the entire content of which is incorporated herein by reference).

Further, there is proposed a method that obtains high spraying pressure applied to the arc especially at the time of large current interruption by dividing the puffer chamber into two parts in the axial direction and restricting the volume of the puffer chamber near the arc and reduces driving force for driving a movable contact portion by providing a check valve at the dividing portion of the puffer chamber so as to avoid high pressure from being applied directly to a piston (refer to Japanese Patent Publication No. 07-97466, the entire content of which is incorporated herein by reference).

In a switchgear that has been in widespread use recently, $SF_6$ gas or air is often used as the arc-extinguishing gas. $SF_6$ gas is excellent in arc-extinguishing performance and electrical insulation performance and is widely used in high-voltage switchgears. On the other hand, the air is often used in a compact type switchgear due to low cost, safety, and environmental friendliness.

$SF_6$ gas is very suitable for use especially in a high-voltage switchgear, while it is known that $SF_6$ gas has a high global warming effect and a reduction in use of $SF_6$ gas is demanded in recent years. In general, the magnitude of global warming effect is represented by global warming potential, that is, by a relative value when global warming potential of $CO_2$ gas is set to 1, and it is known that a global warming potential of $SF_6$ gas reaches 23,900. Although the air is excellent in safety and environment conservation property, the arc-extinguishing performance and electrical insulation performance of the air are significantly inferior to those of $SF_6$, gas, so that it is difficult for the air to be widely applied to the high-voltage switchgear, and the use of the air as the arc-extinguishing gas is considered to be limited to a low to middle-voltage switchgear.

Under such a circumstance, a use of $CO_2$ gas as the arc-extinguishing gas in a switchgear is proposed (refer to Uchii, Kawano, Nakamoto, Mizoguchi, "Fundamental Properties of $CO_2$ Gas as an Arc Extinguishing Medium and Thermal Interruption Performance of Full-Scale Circuit Breaker Model", Transactions B of the Institute of Electrical Engineers of Japan, Vol. 124, No. 3, pp. 469 to 475, 2004, the entire content of which is incorporated herein by reference). $CO_2$ gas has much lower global warming effect than $SF_6$ gas, so that the use of $CO_2$ gas in place of $SF_6$ gas in the switchgear allows an adverse effect on global warming to be significantly reduced. Further, although the arc-extinguishing performance and electrical insulation performance of $CO_2$ gas are inferior to those of $SF_6$ gas, the arc-extinguishing performance of $CO_2$ gas is much superior and insulation performance is equivalent or superior to the air. Thus, by using $CO_2$ gas in place of $SF_6$ gas or air, it is possible to provide a switchgear having satisfactory performance and having environmentally-friendly features in which an adverse effect on global warming is reduced.

In addition to $CO_2$ gas, a use of perfluorocarbon such as $CF_4$ gas, hydrofluorocarbon such as $CH_2F_2$ gas ("Global Environmental Load of $SF_6$ and Insulation of $SF_6$ Mixture or Substitute Gas", Technical report of the Institute of Electrical Engineers of Japan, No. 841, 2001, the entire content of which is incorporated herein by reference), and $CF_3I$ gas (Japanese Patent Application Laid-Open Publication No. 2000-164040, the entire content of which is incorporated herein by reference) as the arc-extinguishing gas in a switchgear is proposed from the same standpoint. The gases mentioned above have a smaller adverse effect on global warming and have comparatively higher arc-extinguishing performance and insulation performance than $SF_6$ gas, so that the above gases are considered to be effective for a reduction in environmental load produced by the switchgear.

Further, there is proposed a method in which in the case where the gas containing element C is applied to the switchgear, an appropriate amount of $O_2$ gas and $H_2$ gas is mixed with the element C containing gas so as to suppress the amount of free carbon to be generated at the time of current interruption to thereby prevent electrical quality degradation due to generation of the free carbon (Japanese Patent Application Laid-Open Publication No. 2007-258137, the entire content of which is incorporated herein by reference).

Further, there is proposed a technique in which a hybrid breaker having contactable and separable two pairs of electrodes and one pair of which constituting a vacuum breaker uses mixed gas containing $CH_4$ as insulation gas in one arc-extinguishing chamber (Japanese Patent Application Laid-Open Publication No. 2001-189118, the entire content of which is incorporated herein by reference).

Further, there is proposed a technique in which a circuit breaker containing contactable and separable two pairs of electrodes in individual arc-extinguish chambers uses mixed gas containing $CH_4$ and $N_2$ (Japanese Patent Application Laid-Open Publication No. 2003-348721, the entire content of which is incorporated herein by reference).

As described above, there has been proposed a technique using $CO_2$ gas, perfluorocarbon, hydrofluorocarbon, or $CF_3I$ gas as an arc-extinguishing medium to provide a switchgear that reduces an adverse effect on global warming as compared to a conventional switchgear using $SF_6$ gas and has satisfactory performance.

In this case, however, the following four serious problems arise.

The first problem is that: all the abovementioned gases contain element C, so that when any of these gases is applied to the switchgear, free carbon may be generated while the gas is dissociated and recombined by high-temperature are generated at the time of current interruption.

If the carbon generated in association with the current interruption is adhered to the surface of a solid insulator such as an insulation spacer, the electrical insulation performance of the solid insulator may be significantly degraded, which may impair the quality of the switchgear.

Further, in the case where any of the above gases is applied to a puffer-type gas insulated circuit breaker and where the heat energy of the arc is actively utilized as a pressure-increasing means for increasing the pressure of a puffer chamber for the purpose of enhancing the interruption performance, the temperature of the gas inevitably becomes higher than a conventional gas insulated circuit breaker mainly utilizing mechanical compression by means of a piston. When the temperature of the gas is increased, specifically, up to about 3000 K or more, dissociation of gas molecules significantly progresses to make it easy to generate carbon. Therefore, when any of the above gases is applied to the puffer-type gas insulated circuit breaker and when the heat energy of the arc is actively utilized for high puffer chamber pressure, the carbon is increasingly easier to be generated, which may impair the quality of the breaker.

To avoid this, it is necessary to restrict a use of the heat energy of the arc so as to prevent the carbon from being generated, so that the interruption current is restricted to be small or spraying pressure rise required for large current interruption needs to be achieved mainly by mechanical compression, which may increase the size and cost of the switchgear.

The second problem is that: among the gases mentioned above, perfluorocarbon, hydrofluorocarbon, and $CF_3I$ gas have a lower global warming potential than $SF_6$ gas but are artificial gases that do not exist in nature, so that when a large volume of these gases is produced for application to the switchgear, greenhouse gases are correspondingly increased on the earth, resulting in an increase in environmental load.

The third problem is that: $CF_3I$ gas and most of the gases belonging to perfluorocarbon and hydrofluorocarbon have complicated molecular structure, so that once the molecules are dissociated by the arc, they are likely to be turned into different molecules in the process of recombination. For example, depending on the value of current to be interrupted or gas condition, $CF_3I$ gas dissociated by the arc may be recombined into $I_2$, $C_2F_6$, and the like. Further, $C_2F_6$ gas may be turned into $CF_4$ having a simpler molecular structure. Thus, when any of these gases is applied to the switchgear, composition of the gas is changed every time current is interrupted, which may result in gradual degradation from expected performance.

The fourth problem concerns mixed gas of $CO_2$ and $O_2$ or mixed gas of $CO_2$ and $H_2$. These gases are naturally-derived gases and can be considered to be truly environmentally friendly. Further, as has been proposed in Japanese Patent Application Laid-Open Publication No. 2007-258137, by mixing an appropriate amount of $O_2$ and $H_2$, it is possible to suppress to some extent the first problem, i.e., generation of free carbon after the current interruption even while using $CO_2$.

However, $O_2$ gas is a representative substance that promotes degradation of an organic material or metal and significantly promotes degradation of especially a metal conductive part exposed to high-temperature environment provided by conduction or an organic material such as a rubber packing, an insulator, a lubricating grease, resulting in a reduction in the device lifetime and an increase in the number of times of device maintenances. In particular, an insulation nozzle is exposed to arc having a temperature of up to several tens of thousands of degrees K, so that the damage becomes significant as the concentration of $O_2$ gas having combustion-supporting property increases, which may result in the combustion if the current value or gas pressure is high.

Further, mixed gas of $CO_2$ and $H_2$ has a problem in terms of safety, electrical insulation property, and gas-tightness. $H_2$ gas has extremely high combustion speed among combustible gases, and the explosive range of $H_2$ gas in the air is as extremely wide as 4 to 75%. If $H_2$ gas is leaked at the operating time or gas handling time, explosion is likely to occur. Further, $H_2$ gas has excellent current interruption performance but has extremely low insulation performance (about 10% or less of the current interruption performance of $CO_2$ gas). Thus, when $H_2$ is mixed with $CO_2$ gas, the insulation gap length needs to be increased in order to ensure sufficient insulation performance, resulting in an increase in the device size. Further, the molecular size of $H_2$ gas is small, making it difficult to ensure gas-tightness. As a result, in order to ensure gas-tightness, doubling of a gas packing or the like is required.

Japanese Patent Application Laid-Open Publications Nos. 2001-189118 and 2003-348721 propose a technique that uses mixed gas containing $CH_4$ and $N_2$ in one of two arc-extinguishing chambers. However, an optimum composition of mixed gas has not been established.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which.

DETAILED DESCRIPTION

Figure 1:
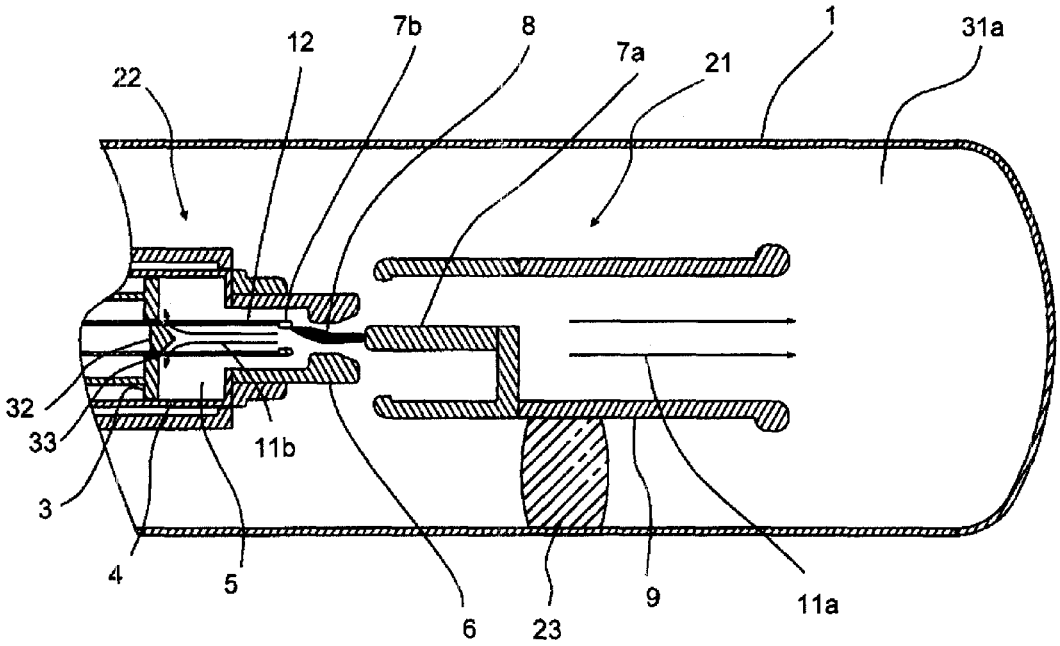
FIG. 1 is a longitudinal cross-sectional view of the main part of a first embodiment of a gas insulated switchgear according to the present invention.

The embodiment of the present invention has been made to solve all the above problems and an object thereof is to provide a gas insulated switchgear having less adverse effect on global warming, excellent performance and quality, and high safety.

In order to achieve the problem, according to an aspect of the invention, there is provided a gas insulated switchgear in which at least a pair of electrical contacts are arranged in a sealed container filled with arc-extinguishing gas, electricity is conducted during conduction by maintaining the two electrical contacts in a contact state, the two electrical contacts are separated during current interruption to generate arc discharge in the arc-extinguishing gas, and current is interrupted by extinguishing the arc, wherein the arc-extinguishing gas is mixed gas mainly comprising $CO_2$ gas and $CH_4$ gas containing 5% or more $CH_4$ gas.

According to another aspect of the invention, there is provided a gas insulated switchgear in which at least a pair of electrical contacts are arranged in a sealed container filled with arc-extinguishing gas, electricity is conducted during conduction by maintaining the two electrical contacts in a contact state, the two electrical contacts are separated during current interruption to generate arc discharge in the arc-extinguishing gas, and current is interrupted by extinguishing the arc, wherein the arc-extinguishing gas is mixed gas mainly comprising $N_2$ gas and $CH_4$ gas containing 30% or more $CH_4$ gas.

Embodiments of a gas insulated switchgear according to the present invention will be described with reference to the accompanying drawings. In the following description, the same reference numerals are used for the same or corresponding parts, and repetitive description may be omitted.

First Embodiment

FIG. 1 is a longitudinal cross-sectional view of the main part of a first embodiment of a gas insulated switchgear according to the present invention, which illustrates a state where interruption operation is being performed. The gas insulated switchgear of FIG. 1 is, e.g., a protective switchgear for a high-voltage transmission system of, e.g., 72 kV or more and is a puffer-type gas insulated circuit breaker. Components illustrated in FIG. 1 each have basically a coaxial cylindrical shape symmetric with an axis (not illustrated) extending in the left-right direction of FIG. 1.

As illustrated in FIG. 1, a sealed container 1 made of grounded metal, an insulator or the like is filled with, as arc-extinguishing gas 31*a*, mixed gas of $CO_2$ gas and $CH_4$ gas containing 5% or more $CH_4$ gas. Specifically, the mixed gas contains $CO_2$ gas (70%)+$CH_4$ gas (30%), for example.

$CO_2$ gas and $CH_4$ gas mentioned above are preferably obtained by collecting and purifying those originally existing in the atmosphere or obtained by collecting and purifying those generated in an organic waste processing and discharged in the course of nature to the atmosphere.

In the sealed container 1, a fixed contact portion 21 and a movable contact portion 22 are disposed opposite to each other. A fixed arc contact 7*a* and a movable arc contact 7*b* are provided in the fixed contact portion 21 and the movable contact portion 22, respectively. At normal operating time, the fixed arc contact 7*a* and the movable arc contact 7*b* are brought into contact and conduction with each other, while at the time of the interruption operation, the fixed arc contact 7*a* and the movable arc contact 7*b* are separated from each other by axial-direction relative movement to generate arc 8 in the space between the fixed arc contact 7*a* and movable arc contact 7*b*. The fixed arc contact 7*a* and movable arc contact 7*b* are each preferably made of a material less melted down by the arc and having high mechanical strength, such as copper-tungsten alloy.

On the movable contact portion 22 side, a gas flow generation means for spraying arc-extinguishing gas 31*a* toward the arc 8 in the form of a gas flow is provided. The gas flow generation means includes here a piston 3, a cylinder 4, a puffer chamber 5, and an insulation nozzle 6. To the fixed contact portion 21 side, an exhaust stack 9 made of metal, through which a fixed-side hot gas flow 11*a* can pass, is attached. Further, on the movable contact portion 22 side, a hollow rod 12 through which a movable-side hot gas flow 11*b* can pass is provided continuing from the movable arc contact 7*b*.

A portion, such as the contact portion, to which high voltage is applied during operating time, is mechanically supported by a solid insulator 23 with the insulation property of that portion ensured by the same. As the solid insulator 23, an epoxy-based material, in which filler such as silica is blended, is used. In a conventional technique in which $SF_6$ gas is used as the arc-extinguishing gas, cracked gas such as HF may be generated in the arc interruption process to allow silica to be affected by HF gas resulting in degradation of characteristics, so that an aluminum-filling material is often used in general. On the other hand, in the present embodiment, an epoxy-based material, in which filler such as silica is blended, can be used.

When the movable contact portion 22 is moved in the left direction in the drawing in the interruption process performed in the gas insulated circuit breaker having the above configuration, the fixed piston 3 compresses the puffer chamber 5 to increase the pressure in the puffer chamber 5 that is the internal space of the cylinder 4. Then, the arc-extinguishing gas 31*a* existing in the puffer chamber 5 is turned in to a high-pressure gas flow. The high-pressure gas flow is then guided to the nozzle, 6 and it is powerfully sprayed against the arc 8 generated between the fixed arc contact 7*a* and the movable arc contact 7*b*. As a result, the conductive arc 8 generated between the fixed arc contact 7*a* and the movable arc contact 7*b* is extinguished to interrupt the current. In general, the higher the pressure in the puffer chamber 5, the more powerfully the arc-extinguishing gas 31*a* is sprayed against the arc 8, so that a higher pressure brings about higher current interruption performance.

The arc-extinguishing gas 31*a* sprayed against the high-temperature arc 8 assumes high temperature, flows as the fixed-side hot gas flow 11*a* and the movable-side hot gas flow lib in the direction away from the space between both the arc contacts, and is finally diffused in the sealed container 1. Not illustrated grease is typically applied on a slidable portion such as a gap between the cylinder 4 and the piston 3 so as to reduce friction.

The increase in the pressure in the puffer chamber 5 is designed to be achieved not only by mechanical compression by means of the piston 3 but also by intentional introduction of heat energy from the arc 8 into the puffer 5. As illustrated in FIG. 1, in the present embodiment, the movable-side hot gas flow 11*b* flowing in the hollow rod 12 is introduced along a guide 32 into the puffer chamber 5 through a communication hole 33, contributing to the pressure increase in the puffer chamber 5.

Here, an advantage obtained by using, as the arc-extinguishing gas 3*a*, mixed gas of $CO_2$ gas and $CH_4$ gas containing 5% or more $CH_4$ gas will be described.

The global warming potentials of $CO_2$ gas and $CH_4$ gas are 1 and 21, respectively, which are much smaller than 23,900 of $SF_6$ gas which has been widely used in the insulating and arc extinguishing medium for the conventional switchgear. Thus, it can be said that the $CO_2$ gas and $CH_4$ gas have much less adverse effect on global environment. Further, unlike $SF_6$ gas and perfluorocarbon, hydrofluorocarbon and $CF_3I$ gas which are proposed as substitute medium for $SF_6$ gas, $CO_2$ gas and $CH_4$ gas are naturally-derived gases existing in nature and are quite unlikely to cause artificial environmental damage. Further, $CO_2$ gas and $CH_4$ gas used here are obtained by collecting those originally existing in the atmosphere or obtained by collecting those discharged in the course of nature to the atmosphere. Therefore, the use of $CO_2$ gas and $CH_4$ gas for the present purpose does not provide newly produced gas on earth. Thus, the use of mixed gas of $CO_2$ gas and $CH_4$ gas as the insulating and arc extinguishing medium for the switchgear contributes to a significant reduction of an adverse effect on the environment.

Further, the mixing of $CH_4$ gas in $CO_2$ gas significantly suppresses the amount of carbon generation.

Figure 2:
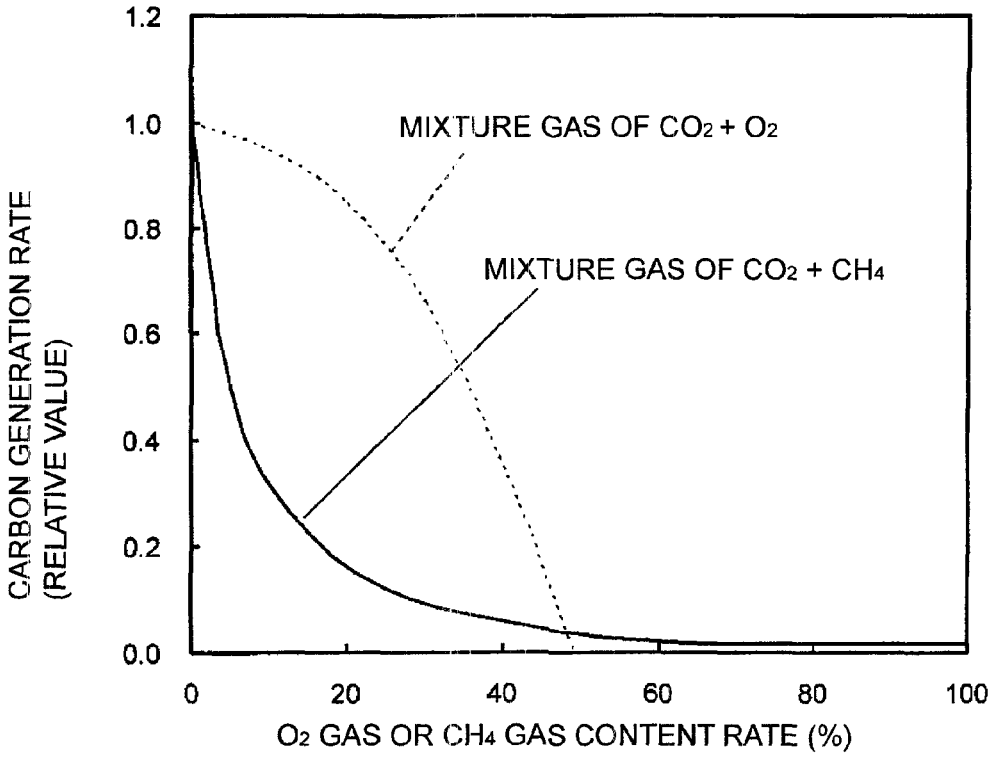
FIG. 2 is a graph illustrating analysis values of the amount of free carbon to be generated in the case where $CH_4$ gas, $CO_2$ gas, $CO_2$+$CH_4$ mixed gas, and $CO_2$+$O_2$ mixed gas are used to generate arc.

FIG. 2 is a graph illustrating analysis values of the amount of free carbon to be generated in the case where $CH_4$ gas, $CO_2$ gas, $CO_2$+$CH_4$ mixed gas, and $CO_2$+$O_2$ mixed gas are used to generate arc. As illustrated in FIG. 2, mixing of 5% $CH_4$ suppresses the amount of carbon generation by substantially half as compared to a case where pure $CO_2$ gas is used, thereby obtaining a sufficiently effective result. When $CH_4$ is mixed by up to 30% as in the case of the present embodiment, it is possible to reduce the amount of carbon generation to 10%, thereby preventing quality degradation associated with the generation of carbon.

This eliminates the need to perform restriction of the usage of the arc heat with respect to the puffer chamber pressure rise aiming to prevent the carbon generation, or this allows the restriction to be alleviated, whereby a switchgear having a reduced size and capable of interrupting large current can be provided.

By mixing $CH_4$ gas, the performance of the gas itself is enhanced as compared to that of $CO_2$ alone.

Figure 3:
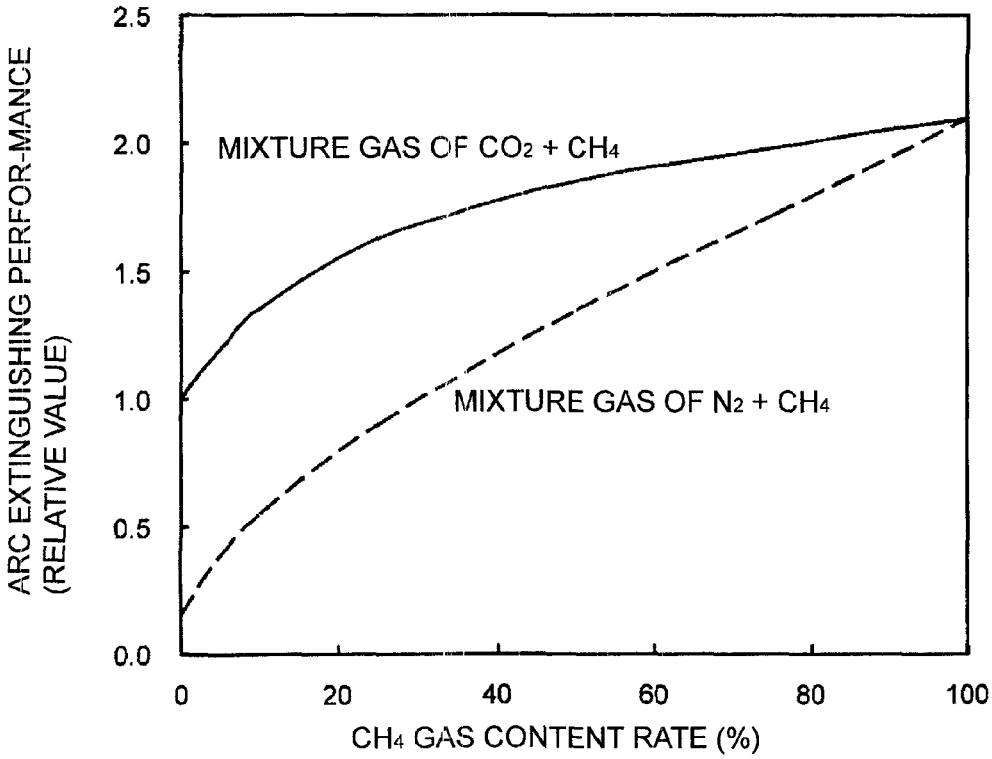
FIG. 3 is a graph illustrating the arc-extinguishing performances of $CH_4$ gas, $CO_2$ gas, $N_2$ gas, $CO_2$+$CH_4$ mixed gas, and $N_2$+$CH_4$ mixed gas.
Figure 4:
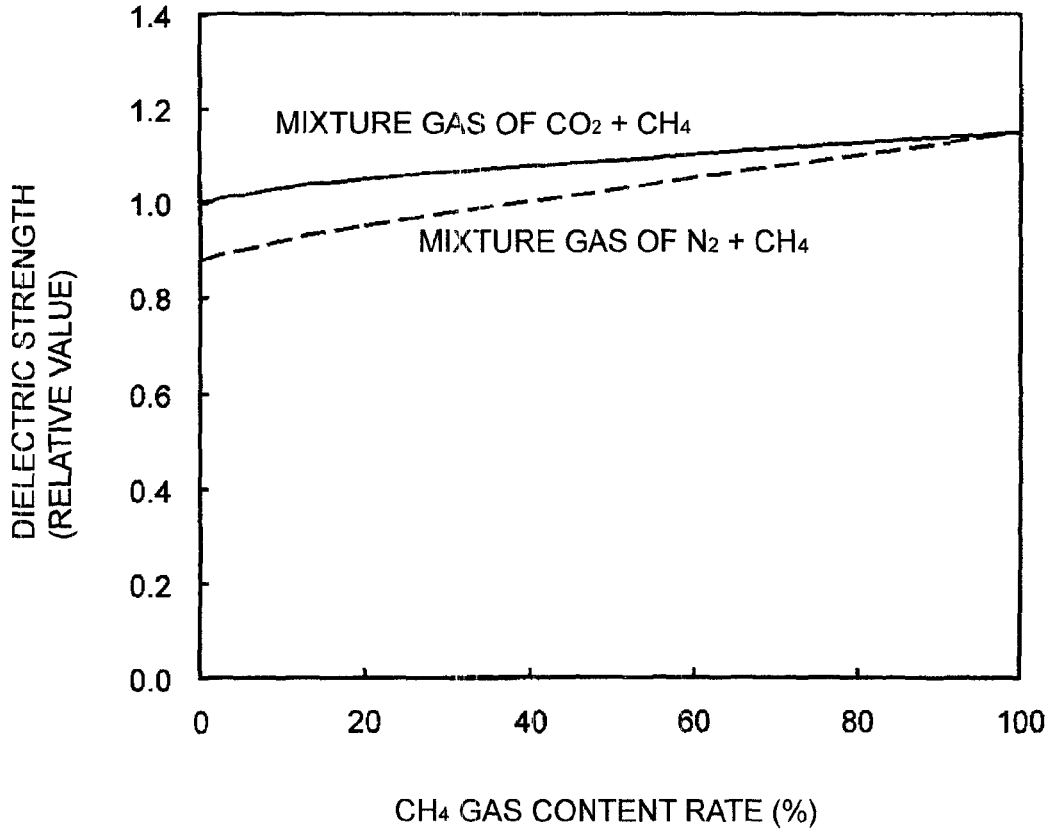
FIG. 4 is a graph illustrating the dielectric strength of $CH_4$ gas, $CO_2$ gas, $N_2$ gas, $CO_2$+$CH_4$ mixed gas, and $N_2$+$CH_4$ mixed gas.

FIG. 3 is a graph illustrating the arc-extinguishing performances of $CH_4$ gas, $CO_2$ gas, $N_2$ gas, $CO_2$+$CH_4$ mixed gas, and $N_2$+$CH_4$ mixed gas. FIG. 4 is a graph illustrating the dielectric strength of $CH_4$ gas, $CO_2$ gas, $N_2$ gas, $CO_2$+$CH_4$ mixed gas, and $N_2$+$CH_4$ mixed gas. As Illustrated in FIGS. 3 and 4, when, for example, $CH_4$ is mixed by 30%, it is possible to enhance both the interruption performance and insulation performance about 1.7 times and 1.1 times those in the case where $CO_2$ alone is used, respectively. Thus, high interruption performance can be obtained even with a single interruption point. That is, it is not necessary to provide a plurality of interruption points, whereby a switchgear having a reduced size and cost can be provided.

$CO_2$ and $CH_4$ have the lowest-level, i.e., simplest molecular structure among the molecules constituted by elements C, O and H, so that unlike gas having complicated molecular structure such as gas belonging to perfluorocarbon or hydrofluorocarbon or $CF_3I$ gas, the molecular structures of $CO_2$ and $CH_4$ are quite unlikely to be turned into different molecular structures in the process of recombination after the molecules are once dissociated by the arc, but are substantially completely turned back into $CO_2$ and $CH_4$ in essence with the original mixing ratio. Therefore, even if current is interrupted many times, a problem that device characteristics are changed does not occur but stable quality can be maintained over a long period of time.

As is well known, 1 mol of $CH_4$ gas is combined with 2 mol of $O_2$ gas, to be brought into combustion to generate heat. There exists no large difference between the heat required for dissociation of 2 mol of $CO_2$ gas and heat generated by combination of 2 mol of $O_2$ and 1 mol of $CH_4$ which are generated after dissociation, so that even when mixed gas of $CO_2$ gas and $CH_4$ gas is heated, there occurs no risk of combustion and explosion. However, if the mixed gas is leaked to the atmosphere from the sealed container, there is a risk of fire. In the present embodiment, the concentration of combustible $CH_4$ gas is diluted with $CO_2$ gas, so that even if encapsulated gas is leaked to the atmosphere, high safety can be maintained.

Conventionally, in the case where sufficient interruption performance cannot be achieved with one pair of electrical contacts, i.e., with a single interruption point, the interruption performance is ensured by serially connecting two pairs of electrical contacts in some cases. According to the present embodiment, high interruption performance can be obtained with a single interruption point owing to excellent characteristics of mixed gas of $CO_2$ gas and $CH_4$ gas, whereby a switchgear achieving reduced size and cost can be provided.

As described above, according to the present embodiment, there can be provided a gas insulated switchgear having less adverse effect on global warming, excellent performance and quality, achieving reduced size and cost, and having high safety.

Second Embodiment

Figure 5:
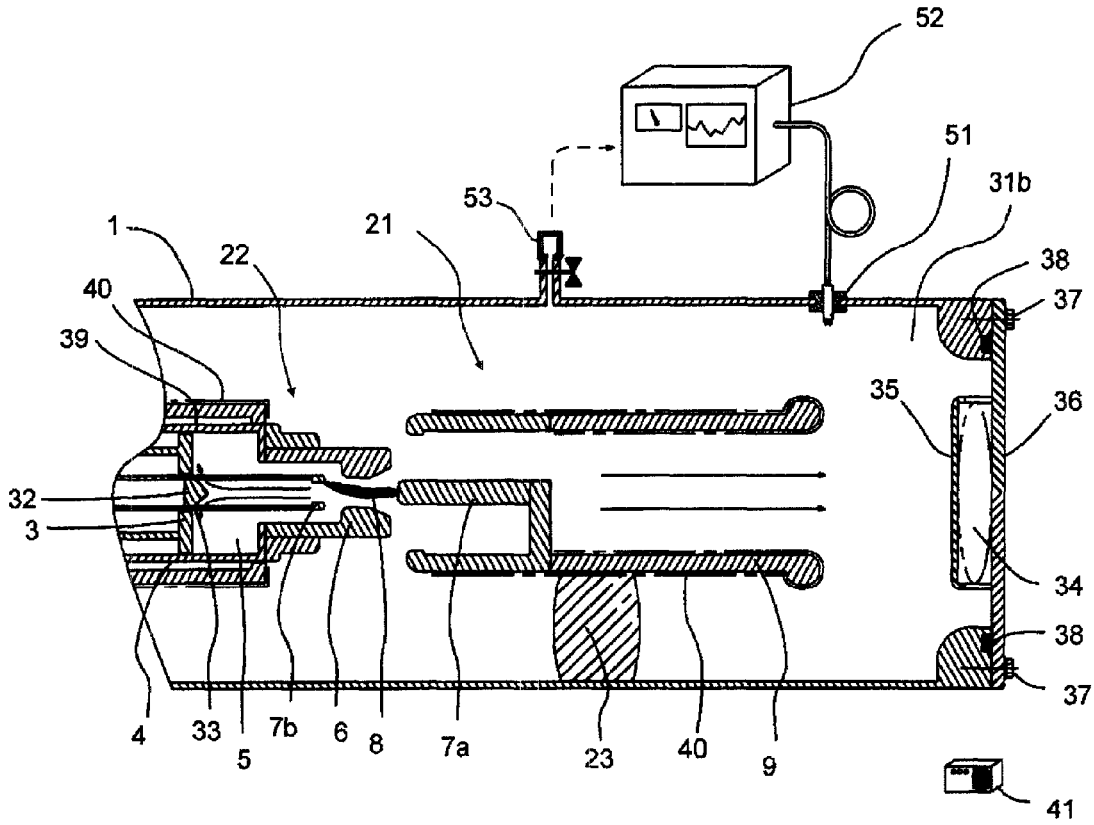
FIG. 5 is a longitudinal cross-sectional view of the main part of a second embodiment of the gas insulated switchgear according to the present invention.

FIG. 5 is a longitudinal cross-sectional view of the main part of a second embodiment of the gas insulated switchgear according to the present invention, which illustrates a state where interruption operation is being performed. The configuration of the gas insulated switchgear according to the second embodiment is basically the same as that of the first embodiment illustrated in FIG. 1 but differs in the following points.

In the second embodiment, mixed gas of $CO_2$ gas and $CH_4$ gas containing 5% or more $CH_4$ gas is used as arc-extinguishing gas 31*b* to be encapsulated in the sealed container 1 as in the arc-extinguishing gas 31*a* of the first embodiment.

A lid 36 for internal inspection is fitted over the sealed container 1 by means of fastening bolts 37 so as to seal the sealed container 1. A packing 38 is provided in the connection part of the lid 36 so as to keep gas-tightness of the arc-extinguishing gas 31*b* filled in the sealed container 1. The packing 38 may be nitrile rubber, fluoro rubber, silicone rubber, acrylic rubber, ethylene propylene rubber, ethylene propylene diene rubber, butyl rubber, urethane rubber, Hypalon, or EVA resin.

Grease 39 having lubricating property is applied on the surface sliding when the fixed arc contact 7*a* and the movable arc contact 7*b* are separated from each other, specifically, the outer circumferential surface of the cylinder 4 so as to reduce friction. The grease used here may be silicone grease.

A surface treatment coating film 40 such as a phosphoric acid treatment film, an alumina film, a fluorinated coating, paint or the like is applied on at least a part of the metal surface where no contact conduction takes place, specifically, the outer circumferential surfaces of the fixed contact portion 21 and movable contact portion 22 and inner surface of the exhaust stack 9.

An absorbent 34 capable of preferentially absorbing moisture is disposed inside the sealed container 1. The absorbent 34 is retained in the sealed container 1 by a casing 35.

A detection means for detecting CO gas or $O_3$ gas is provided in the sealed container 1. More specifically, a sensor 51 capable of detecting CO gas or $O_3$ gas is provided in the sealed container 1, and information detected by the sensor 51 is analyzed by an analyzer 52. Another configuration may be adopted in which only a small amount of gas in the sealed container 1 is collected and fed to a sampling container 53 for analysis of the contents of CO gas and $O_3$ gas in the collected gas by the analyzer.

An alarm device 41 is provided outside the sealed container 1 around the portion at which the packing 38 for sealing is provided. The alarm device 41 detects $CH_4$ gas and outputs detection information by some kind of means.

According to the second embodiment, excellent interruption performance and insulation performance can be obtained as in the first embodiment.

Although there is a small possibility that an extremely small amount of moisture ($H_2O$) is generated under some condition, the moisture is selectively absorbed and removed by the absorber 34 in the second embodiment. Therefore, degradation in the insulation property or generation of corrosion is not caused due to existence of the moisture.

Further, since the alarm device 41 is disposed in the present embodiment, it is possible to always monitor occurrence of leakage.

As described above, mixing of $O_2$ and $H_2$ into $CO_2$ gas is proposed for reducing carbon generation associated with current interruption. However, $O_2$ gas is a typical substance that promotes degradation of an organic material or metal and significantly promotes degradation of especially a metal conductive part exposed to high-temperature environment provided by conduction or an organic material such as a rubber packing, an insulator, a lubricating grease, resulting in a reduction in the device lifetime and an increase in the number of times of device maintenances. In particular, the insulation nozzle 6 is exposed to the arc 8 having a temperature of up to several tens of thousands of degrees K, so that the damage becomes significant as the concentration of $O_2$ gas having combustion-supporting property increases, which may result in the combustion if the current value or gas pressure is high. Further, $H_2$ has a problem in terms of safety, electrical insulation property, and gas-tightness.

Figures 6, 7:
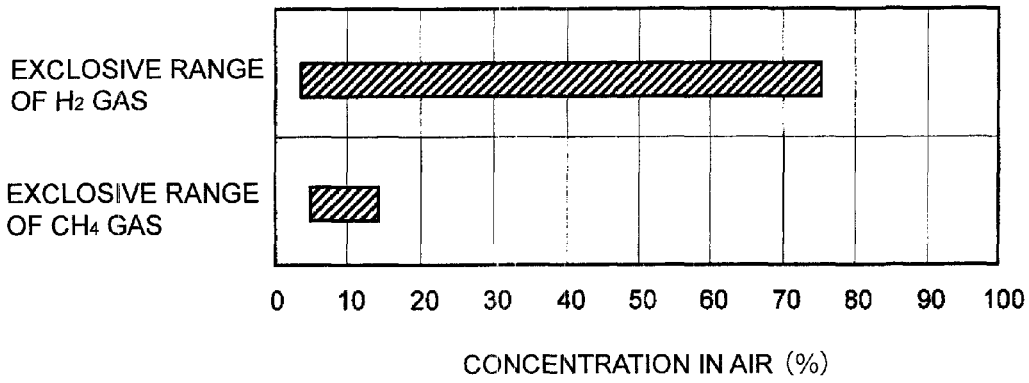
FIG. 6 is a graph illustrating the explosive ranges of $H_2$ gas and $CH_4$ gas in the air.
FIG. 7 is a table representing a relative comparison between the voltage-resistance performance of $CO_2$ gas, $O_2$ gas, $CH_4$ gas, and $H_2$ gas.

FIG. 6 is a graph illustrating the explosive ranges of $H_2$ gas and $CH_4$ gas in the air. $H_2$ gas has extremely high combustion speed among combustible gases, and the explosive range of $H_2$ gas in the air is as extremely wide as 4 to 75%. If $H_2$ gas is leaked at the operating time or gas handling time, there is a risk of explosion. The explosive range of $CH_4$ in the air is 5 to 14%.

FIG. 7 is a table representing a relative comparison between the voltage-resistance performance of $CO_2$ gas, $O_2$ gas, $CH_4$ gas, and $H_2$ gas. The $H_2$ gas has excellent current interruption performance but has extremely low insulation performance (about 10% or less of the current interruption performance of $CO_2$ gas as illustrated in FIG. 7). Thus, when $H_2$ is mixed with $CO_2$ gas, the insulation gap length needs to be increased in order to ensure sufficient insulation performance, resulting in an increase in the device size. Further, the molecular size of $H_2$ gas is small, making it difficult to ensure gas-tightness. As a result, in order to ensure gas-tightness, doubling of a gas packing or the like is required. By mixing, in place of $H_2$, $CH_4$ with $CO_2$, the abovementioned problems can be solved at the same time. That is, the problem of degradation/damage caused by $O_2$ gas and problem of degradation in safety, increase in size, and degradation in gas-tightness caused by $H_2$ gas can be eliminated.

In the case where some insulation failure occurs in the sealed container 1 to cause continuous partial discharge, CO gas or $O_3$ gas is continuously generated by the partial discharge. To cope with this, the presence/absence or concentration of such gas is analyzed and monitored by means of the sensor 51 or sampling container 53, whereby occurrence of the partial discharge which is a precursor phenomenon of insulation breakdown can be detected. Thus, it is possible to detect the abnormal state in the early stage before complete insulation breakdown occurs. Then, an appropriate measures can be implemented to thereby minimize the damage resulting from device failure.

$O_3$ gas has a strong denaturating and degrading action on the rubber used in the packing 38. This in turn can impair the quality of a switchgear or reduce safety, resulting in occurrence of gas leakage, etc. Degradation of the packing 38 can be prevented, however, by using as the packing, a material substantially resistant to $O_3$, such as, nitrile rubber, fluoro rubber, silicone rubber, acrylic rubber, ethylene propylene rubber, ethylene propylene diene rubber, butyl rubber, urethane rubber, Hypalon, or EVA resin.

The generated $O_3$ gas may promote oxidative degradation of the lubricating grease 39 applied on the sliding surface. Using a silicone grease having a strong resistance to these gases allows preserving lubricity.

Subjecting the metal surface where no contact conduction takes place to surface treatment involving, for example, a phosphoric acid treatment film, an alumina film, a fluorinated coating, paint or the like allows preventing more reliably oxidative corrosion or modification caused due to generation of moisture or $O_3$ from occurring on the treated portion.

According to the second embodiment described above, there can be provided a gas insulated switchgear having less adverse effect on global warming, excellent performance and quality, achieving reduced size and cost, and having high safety. Further, the state of the device can be grasped so that accurate check and replacement times can be decided.

Third Embodiment

A third embodiment of the gas insulated switchgear according to the present invention will be described. The basic configuration of the third embodiment is the same as those of the first and second embodiments, and the illustration thereof is omitted.

In the third embodiment, mixed gas of $N_2$ gas and $CH_4$ gas containing 30% or more $CH_4$ gas is used as arc-extinguishing gas. In a specific example, the mixed gas contains $N_2$ (70%)+ $CH_4$ (30%).

$CH_4$ gas mentioned above are preferably obtained by collecting and purifying those originally existing in the atmosphere or obtained by collecting and purifying those generated in an organic waste processing and discharged in the course of nature to the atmosphere.

Effects that can be obtained by the present embodiment is the same as those obtained by the second embodiment, i.e., those brought about by mixed gas of $CO_2$ gas and $OH_4$ gas. In addition, $N_2$ has a global warming potential of 0 and is the main component of the air, so that using $N_2$ gas in place of $CO_2$ further reduces an adverse effect on the environment. Further, $N_2$ is less expansive due to wide distribution fo industrial use.

Further, $N_2$ does not contain element C, $N_2$ itself does not contribute at all to the carbon generation.

However, $N_2$ gas is inferior to $CO_2$ gas in the arc-extinguishing performance and insulation performance, which may lead to an increase in the device size or performance degradation. However, as illustrated in FIGS. 3 and 4, by mixing 30% or more $CH_4$ in $N_2$ gas, it is possible to obtain interruption performance and insulation performance substantially equivalent to that obtained by $CO_2$ gas alone.

According to the third embodiment described above, there can be provided a gas insulated switchgear having less adverse effect on global warming, excellent performance and quality, achieving reduced size and cost, and having high safety.

Fourth Embodiment

Figure 8:
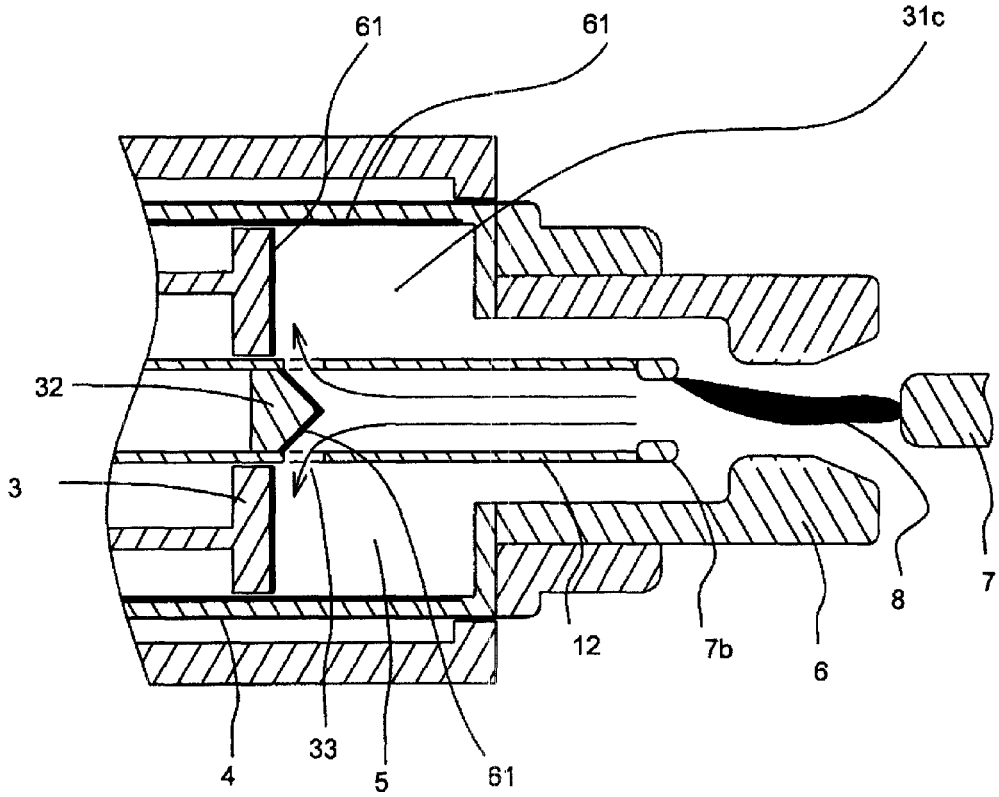
FIG. 8 is a longitudinal cross-sectional view of the main part of a fourth embodiment of the gas insulated switchgear according to the present invention.

FIG. 8 is a longitudinal cross-sectional view of the main part of a fourth embodiment of the gas insulated switchgear according to the present invention, which illustrates a state where interruption operation is being performed. The configuration of the gas insulated switchgear according to the fourth embodiment is basically the same as those of the first, second, and third embodiments but differs in the following two points.

In the fourth embodiment, gas obtained by adding 2% or less $O_2$ or $H_2$ gas to $CH_4$ gas or mixed gas of $CO_2$ gas and $CH_4$ gas is adopted as arc-extinguishing gas 31*c*. In a specific example, in the present embodiment, gas obtained by mixing 2% $O_2$ gas in mixed gas of $CO_2$ gas and $CH_4$ gas is used as the arc-extinguishing gas.

Further, solid-state components 61 each containing element O or H are provided at positions exposed to the arc 8 or to the flow of gas heated by the arc 8. Specifically, solid-state components 61 are respectively arranged in the vicinity of the surface of the guide 32 and inside the cylinder 4. As the material of the solid-state components 61, polyethylene, polyamide, polymethylmethacrylate, or polyacetal is used.

The above two measures of adding $O_2$ or $H_2$ gas to the arc-extinguishing gas 31*c* and providing the solid-state components 61 containing element O or H bring about the same effect. Therefore, by practicing only one of the above two measures, i.e., without practicing the above two measure at the same time, it is possible to obtain a sufficient effect. In the present embodiment, both the above two measures are assumed to be implemented.

Further, as the insulation nozzle 6, polytetrafluoroethylene is used as an example.

The gas molecules such as $CO_2$ and $CH_4$ are dissociated in the vicinity of the arc 8 into various ion particles and electrons. The temperature of the arc is decreased in the current interruption process, and the particles are recombined into gas particles. At this time, O ions are consumed in the oxidation of metal such as fixed arc contact 7*a* and movable arc contact 7*b*, and element O required for recovering $CO_2$ gas becomes partly insufficient, resulting in generation of CO gas. Similarly, element H required for recovering $CH_4$ gas become partly insufficient because element H is bound to F ions mixed resulting from evaporation of the insulation nozzle 6, resulting in generation of hydrocarbon-based gas such as $C_2H_4$ other than $CH_4$. Therefore, the repetition of the current interruption causes the composition of the gas in the sealed container to be gradually changed, resulting in a change in the performance of a switchgear. Further, CO gas is toxic gas, so that it is preferable to suppress generation of CO gas as low as possible.

Previously mixing an appropriate amount of $O_2$ gas or $H_2$ gas prevents occurrence of a problem of shortage of O or H ions for recovering $CO_2$ or $CH_4$ even if O is consumed in the oxidation of the arc contact or H is consumed for generation of HF and, therefore, the amounts of $CO_2$ gas and $CH_4$ gas are maintained. As a result, stable performance of a switchgear can be maintained. Further, toxic CO gas is not generated.

Figure 9:
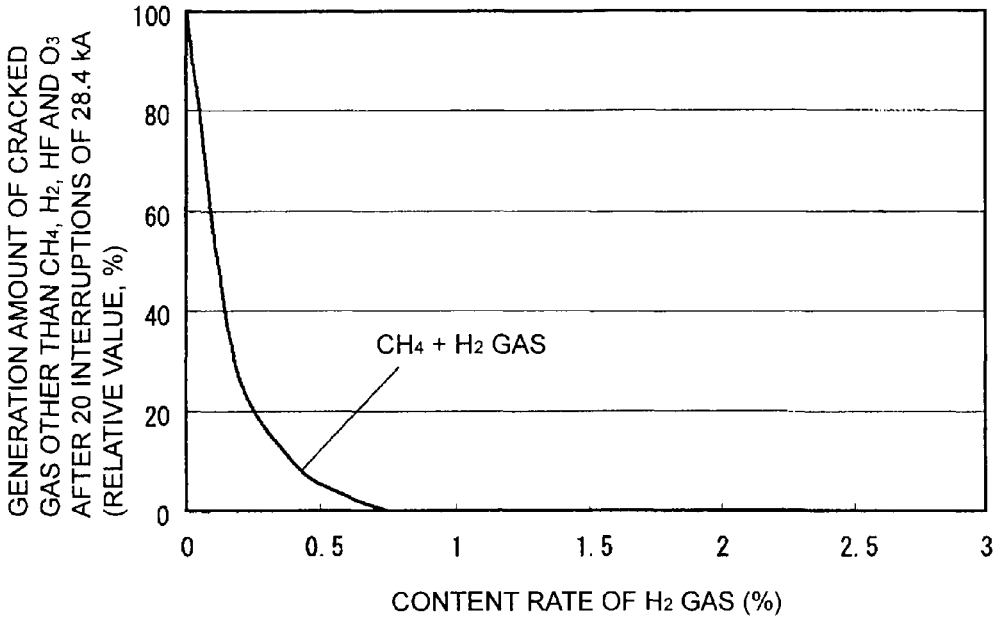
FIG. 9 is a graph illustrating the generation amount of cracked gas other than $CH_4$ gas, $H_2$ gas, HF gas, and $O_3$ gas after large current is interrupted many times in $CH_4$ and $H_2$ mixed gas.
Figure 10:
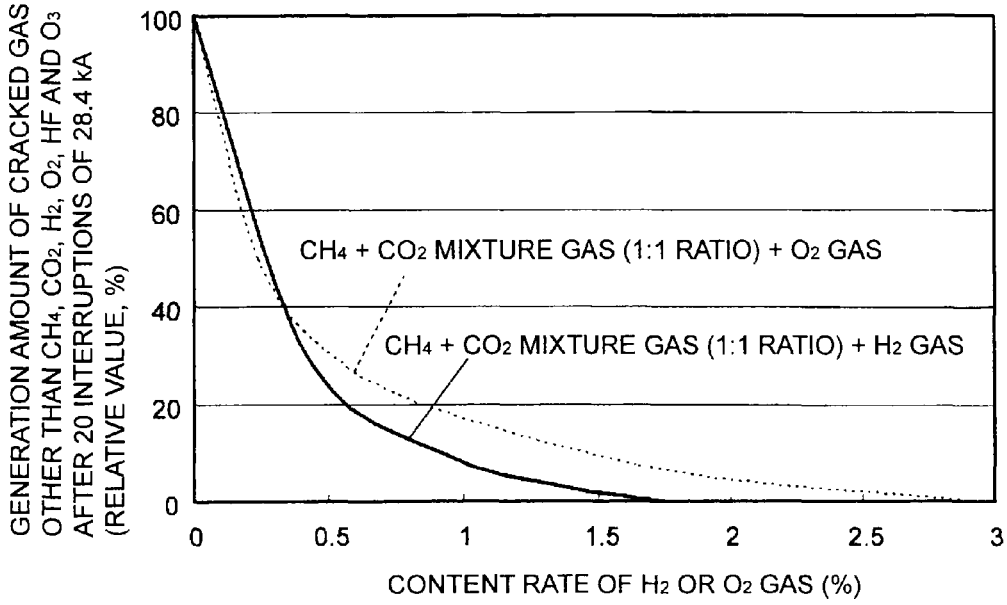
FIG. 10 is a graph illustrating the generation amount of cracked gas other than $CH_4$ gas, $CO_2$ gas, $H_2$ gas, $O_2$ gas, HF gas, and $O_3$ gas after large current is interrupted many times in $CH_4$+$CO_2$+$H_2$ mixed gas and $CH_4$+$CO_2$+$O_2$ mixed gas.

FIG. 9 is a graph illustrating the generation amount of cracked gas other than $CH_4$ gas, $H_2$ gas, HF gas, and $O_3$ gas after large current is interrupted many times in mixed gas of $CH_4$ and $H_2$. FIG. 10 is a graph illustrating the generation amount of cracked gas other than $CH_4$ gas, $CO_2$ gas, $H_2$ gas, $O_2$ gas, HF gas, and $O_3$ gas after large current is interrupted many times in $CH_4$+$CO_2$+$H_2$ mixed gas and $CH_4$+$CO_2$+$O_2$ mixed gas. More specifically, in both FIGS. 9 and 10, value obtained after current of 28.4 kA is interrupted 20 times are illustrated. As is clear from FIGS. 9 and 10, by additionally mixing about 2% $H_2$ or $O_2$ gas as described above, the generation amount of the cracked gas is significantly reduced. The reason that HF and $O_3$ are excluded in addition to $CH_4$, $CO_2$, $H_2$, and $O_2$ which have originally been encapsulated is because HF and $O_3$ gases have high reactivity and, even if generated, most of them are eliminated due to secondary reaction or absorption to the metal surface of the sealed container after elapse of a certain amount of time.

The amount of $H_2$ or $O_2$ gas to be additionally mixed is restricted up to 2% of the total gas amount, which prevents the performance of a switchgear from significantly changing due to the mixing of the additional gas.

By additionally mixing 2% or less $H_2$ or $O_2$ gas as described above, it is possible to significantly suppress generation of gas, such as CO that has not originally exist without substantially changing the characteristics of a switchgear.

Further, in place of previously mixing $O_2$ or $H_2$ gas, by providing solid-state components 61 containing element O or H at positions exposed to the arc 8 or to the flow of gas heated by the arc 8, the same effect can be obtained. Because the solid-state components 61 are exposed to the flow of high-temperature gas to be melted and evaporated, with the result that elements O or H are locally provided in the vicinity of the arc during current interruption.

In the case where mixed gas is applied to a switchgear, the mixing ratio of the mixed gas need to be monitored at the operating time so that designed performance is always achieved. Thus, it is preferable in terms of management required at the operating time that the number of kinds of gases to be mixed is as small as possible. The use of melting and evaporation phenomena of the solid-state components 61 eliminates the need to previously mix $O_2$ or $H_2$ gas, thereby saving the labor of device management.

With the above configuration, there can be provided a gas insulated switchgear having less adverse effect on global warming, excellent performance and quality, achieving reduced size and cost, and having high safety. In particular, according to the present embodiment, it is possible to significantly reduce a possibility of generating gas, such as toxic CO gas that has not originally exist.

Other Embodiments

The embodiments described above are merely given as examples, and it should be understood that the present invention is not limited thereto. For example, the components of the arc-extinguishing gas exemplified in the respective embodiments are main components, and other impure gases may be contained in the arc-extinguishing gas. Further, the features of different embodiments may be combined together. Further, although the puffer-type gas insulated circuit breaker is taken as an example in the above embodiments, the present invention may be applied to a gas insulated switchgear of other types.

What is claimed is:

1. A gas insulated switchgear in which at least a pair of electrical contacts are arranged in a sealed container filled with arc-extinguishing gas, electricity is conducted during conduction by maintaining the two electrical contacts in a contact state, the two electrical contacts are separated during current interruption to generate arc discharge in the arc-extinguishing gas, and current is interrupted by extinguishing the arc, wherein the arc-extinguishing gas is mixed gas mainly comprising $CO_2$ gas and $CH_4$ gas containing 5% or more $CH_4$ gas.

2. A gas insulated switchgear in which at least a pair of electrical contacts are arranged in a sealed container filled with arc-extinguishing gas, electricity is conducted during conduction by maintaining the two electrical contacts in a contact state, the two electrical contacts are separated during current interruption to generate arc discharge in the arc-extinguishing gas, and current is interrupted by extinguishing the arc, wherein the arc-extinguishing gas is mixed gas mainly comprising $N_2$ gas and $CH_4$ gas containing 30% or more $CH_4$ gas.

3. The gas insulated switchgear according to claim 1, comprising:

a pressure accumulation space formed in the sealed container so as to accumulate the arc-extinguishing gas, pressure of which in an internal space is increased by heat energy of the arc; and a gas flow path connecting the pressure accumulation space and the arc, wherein the switchgear is so constructed that the arc-extinguishing gas accumulated in the pressure accumulation space and whose pressure is increased by heat energy of the arc passes through the gas flow path and is sprayed against the arc.

4. The gas insulated switchgear according to claim 1, wherein an absorbent capable of preferentially absorbing moisture is disposed inside the sealed container.

5. The gas insulated switchgear according to claim 1, wherein a solid insulator for electrically insulating a portion in the sealed container to which voltage is applied and mechanically supporting the portion is formed of an epoxy-based material in which silica is blended.

6. The gas insulated switchgear according to claim 1, wherein a packing made of a material selected from nitrile rubber, fluoro rubber, silicone rubber, acrylic rubber, ethylene propylene rubber, ethylene propylene diene rubber, butyl rubber, urethane rubber, Hypalon, or EVA resin is used for sealing the arc-extinguishing gas in the sealed container.

7. The gas insulated switchgear according to claim 1, wherein lubricating silicone grease is applied to surfaces of two electrical contacts that slide together during the separation operation of the two electrical contacts.

8. The gas insulated switchgear according to claim 1, wherein surface treatment selected from a phosphoric acid treatment film, an alumina film, a fluorinated coating or paint is applied to at least part of metal surface where no contact conduction takes place.

9. The gas insulated switchgear according to claim 1, comprising detection means for detecting CO gas or $O_3$ gas inside the sealed container.

10. The gas insulated switchgear according to claim 1, wherein the arc-extinguishing gas is mixed gas containing 2% or less $O_2$ or $H_2$ gas.

11. The gas insulated switchgear according to claim 1, wherein a solid-state component comprising element O or element H is arranged at a position exposed to the arc or to flow of the arc-extinguishing gas heated by the arc.

12. The gas insulated switchgear according to claim 1, wherein $CH_4$ gas or $CO_2$ gas filled in the sealed container are obtained by collecting and purifying gas originally existing in atmosphere or obtained by collecting and purifying gas generated in an organic waste processing and discharged in course of nature to the atmosphere.

13. The gas insulated switchgear according to claim 2, comprising:

a pressure accumulation space formed in the sealed container so as to accumulate the arc-extinguishing gas, pressure of which in an internal space is increased by heat energy of the arc; and a gas flow path connecting the pressure accumulation space and the arc, wherein the switchgear is so constructed that the arc-extinguishing gas accumulated in the pressure accumulation space and whose pressure is increased by heat energy of the arc passes through the gas flow path and is sprayed against the arc.

14. The gas insulated switchgear according to claim 2, wherein an absorbent capable of preferentially absorbing moisture is disposed inside the sealed container.

15. The gas insulated switchgear according to claim 2, wherein a solid insulator for electrically insulating a portion in the sealed container to which voltage is applied and mechanically supporting the portion is formed of an epoxy-based material in which silica is blended.

16. The gas insulated switchgear according to claim 2, wherein a packing made of a material selected from nitrile rubber, fluoro rubber, silicone rubber, acrylic rubber, ethylene propylene rubber, ethylene propylene diene rubber, butyl rubber, urethane rubber, Hypalon, or EVA resin is used for sealing the arc-extinguishing gas in the sealed container.

17. The gas insulated switchgear according to claim 2, wherein lubricating silicone grease is applied to surfaces of two electrical contacts that slide together during the separation operation of the two electrical contacts.

18. The gas insulated switchgear according to claim 2, wherein surface treatment selected from a phosphoric acid treatment film, an alumina film, a fluorinated coating or paint is applied to at least part of metal surface where no contact conduction takes place.

19. The gas insulated switchgear according to claim 2, comprising detection means for detecting CO gas or $O_3$ gas inside the sealed container.

20. The gas insulated switchgear according to claim 2, wherein the arc-extinguishing gas is mixed gas containing 2% or less $O_2$ or $H_2$ gas.

21. The gas insulated switchgear according to claim 2, wherein a solid-state component comprising element O or element H is arranged at a position exposed to the arc or to flow of the arc-extinguishing gas heated by the arc.

22. The gas insulated switchgear according to claim 2, wherein $CH_4$ gas or $CO_2$ gas filled in the sealed container are obtained by collecting and purifying gas originally existing in atmosphere or obtained by collecting and purifying gas generated in an organic waste processing and discharged in course of nature to the atmosphere.

* * * * *